US007420335B2

(12) United States Patent
Robinson et al.

(10) Patent No.: US 7,420,335 B2
(45) **Date of Patent: *Sep. 2, 2008**

(54) SWITCHED CONSTANT CURRENT DRIVING AND CONTROL CIRCUIT

(75) Inventors: Shane P. Robinson, Vancouver (CA); Paul Jungwirth, Burnaby (CA); Ion Toma, Richmond (CA)

(73) Assignee: TIR Technology LP, Burnaby, BC (CA)

( * ) Notice: Subject to any disclaimer, the term of this patent is extended or adjusted under 35 U.S.C. 154(b) by 74 days.

This patent is subject to a terminal disclaimer.

(21) Appl. No.: 11/549,576

(22) Filed: Oct. 13, 2006

(65) Prior Publication Data

US 2007/0069664 A1 Mar. 29, 2007

Related U.S. Application Data

(62) Division of application No. 11/101,046, filed on Apr. 6, 2005, now Pat. No. 7,202,608.

(60) Provisional application No. 60/583,607, filed on Jun. 30, 2004.

(51) Int. Cl.
*H05B 37/02* (2006.01)

(52) U.S. Cl. ..... 315/224; 315/185 R; 315/192; 315/307; 315/308

(58) Field of Classification Search ..... 315/291, 315/307, 308, 185 R, DIG. 4, 192, 224
See application file for complete search history.

(56) References Cited

U.S. PATENT DOCUMENTS 4,001,667 A 1/1977 Bober
4,870,327 A 9/1989 Jorgensen
5,416,387 A 5/1995 Cuk et al.
5,519,289 A 5/1996 Katyl et al.
6,362,578 B1 3/2002 Swanson et al.
6,392,358 B1 * 5/2002 Runau et al. ..... 315/185 R
6,407,515 B1 6/2002 Hesler et al.
6,586,890 B2 7/2003 Min et al.
6,670,780 B2 12/2003 Ono et al.
6,734,639 B2 5/2004 Chang et al.
6,747,420 B2 6/2004 Barth et al.
6,864,642 B2 3/2005 Nemirow et al.
6,870,325 B2 3/2005 Bushell et al.
6,987,787 B1 1/2006 Mick
2002/0113559 A1 8/2002 Lam
2002/0130786 A1 9/2002 Weindorf
2004/0036418 A1 2/2004 Rooke et al.
2004/0251854 A1 12/2004 Matsuda et al.

* cited by examiner

*Primary Examiner*—David Hung Vu
(74) *Attorney, Agent, or Firm*—Dorsey & Whitney LLP

(57) ABSTRACT

The driving and control device provides a desired switched current to a load including two or more strings of one or more electronic devices. The device includes one or more voltage converters which convert the magnitude of the voltage from the power supply to another magnitude that is desired at the high side of the load. The device may also include one or more dimming controls which provide control of the activation and deactivation of the load. The device may further include a feedback signal to the voltage converter that is indicative of the current flowing through the load. Based on the feedback signal received, the voltage converter can subsequently adjust its output voltage such that a constant switched current is provided to the load.

23 Claims, 14 Drawing Sheets

(a) (Prior Art)

SWITCHED CONSTANT CURRENT DRIVING AND CONTROL CIRCUIT

CROSS-REFERENCE TO RELATED APPLICATIONS

This application is a divisional patent application of U.S. patent application Ser. No. 11/101,046, filed Apr. 6, 2005, and entitled "Switched Constant Current Driving and Control Circuit", now U.S. Pat. No. 7,202,608, which claims the benefit under 35 U.S.C. § 119(e) of U.S. Provisional Application No. 60/583,607, filed Jun. 30, 2004, and entitled "Switched Constant Current Driving and Control Circuit", each of which are hereby incorporated by reference herein in their entireties.

FIELD OF THE INVENTION

The present invention pertains to the field of driver circuits, and more particularly, to driver circuits that provide switched constant current sources for electronic devices such as light-emitting elements.

BACKGROUND

Recent advances in the development of semiconductor light-emitting diodes (LEDs) and organic light-emitting diodes (OLEDs) have made these devices suitable for use in general illumination applications, including architectural, entertainment, and roadway lighting, for example. As such, these devices are becoming increasingly competitive with light sources such as incandescent, fluorescent, and high-intensity discharge lamps.

Light-emitting diodes are current driven devices, meaning that the amount of current passing through an LED controls its brightness. In order to avoid variations in brightness between adjacent devices, the current flowing through the LEDs and their control circuits should be closely matched. Manufacturers have implemented several solutions to address the need to closely control the amount of current flowing through the LEDs. One solution is to keep a constant current flowing through the LEDs using a linear constant current circuit. A problem with using a linear constant current circuit, however, is that the control circuit dissipates a large amount of power, and consequently requires large power devices and heat sinks. In addition, when any non-switched constant current system is dimmed, 0 to 100% dimming is typically not achievable. For example, at lower current levels some LEDs will remain ON whereas others, with higher forward voltages will not.

A more power efficient solution has been attempted which uses a buck-boost regulator to generate a regulated common voltage supply for the high side of the LED arrays. Low side ballast resistors are then used to set the LED current, and separate resistors are used to monitor the current. For example, U.S. Pat. No. 6,362,578 provides a method wherein a voltage converter with feedback is used to maintain a constant load voltage across a series of strings of LEDs and biasing resistors are used for current control. A transistor is connected on the low side of the LEDs and is switched with Pulse Width Modulation (PWM) for brightness control. This design does provide full dimming control as the current is switched, wherein the same current can be maintained when the PWM switch is ON, while not allowing current when the switch is OFF. The average current is then equal to the duty cycle multiplied by the ON current level. The problem with these types of designs is that they are inefficient due to the power losses in the biasing resistor, and may require custom resistors to accurately control the current.

U.S. Pat. No. 4,001,667 also discloses a closed loop circuit that provides constant current pulses, however, this circuit does not allow for full duty cycle control over the LEDs.

U.S. Pat. No. 6,586,890 discloses a method that uses current feedback to adjust power to LEDs with a low frequency PWM signal supplied to the power supply in order to reduce the brightness of the LEDs when in a dim mode. The problem with this method is that if the low frequency signal is within the range of 20 Hz to 20,000 Hz, as disclosed, the power supply can produce audible noise. Also, switching frequencies in this range can thermally cycle the LED's thus likely reducing the reliability and lifetime of the device.

U.S. Pat. No. 6,734,639 B2 discloses a method for controlling overshoots of a switched driving circuit for LED arrays by means of a voltage converter combined with a customized sample and hold circuit. The switching signal controlling the LEDs is linked to a signal to enable and disable the voltage converter and thus it is switching both the load and the supply. The signal controlling the switching of the load is biased such that it operates the switch essentially in its linear region in order to provide peak current control which can result in power losses within the switch, thereby reducing the overall system efficiency. In addition, this configuration is defined as being applicable for frequencies in the range of 400 Hz and does not allow for high frequency switching of the load for example at frequencies above the 20 kHz which is approximately the audible threshold range.

U.S. patent application Ser. No. 2004/0036418 further discloses a method of driving several strings of LEDs in which a converter is used to vary the current through the LEDs. A current switch is implemented to provide feedback. This method is similar to using a standard buck converter and can provide an efficient way for controlling the current through the LEDs. A problem arises, however when multiple LED strings require different forward voltages. In this scenario, high-side transistor switches are used as variable resistors to limit the current to the appropriate LED string. These high side transistor switches can induce large losses and decrease the overall efficiency of the circuit. In addition, this circuit does not allow a full range of dimming to be obtained.

Therefore, there is a need for a switched constant current driver circuit that efficiently provides voltages to multiple electronic devices according to the forward bias required thereby without the use of biasing resistors or transistors. In addition, there is a need for efficiently dimming light-emitting elements while maintaining a switched constant current.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a driving and control circuit with switched constant current output. In accordance with one aspect of the present invention there is provided a driving and control device for providing a desired switched current to a load including a string of one or more electronic devices, said device comprising: a voltage converter adapted for connection to a power supply, said voltage converter for converting voltage from the power supply from a first magnitude voltage to a second magnitude voltage, said voltage converter responsive to a control signal; a dimming control device receiving said second magnitude voltage and controlling transmission of the second magnitude voltage to said string thereby controlling activation of said string; a voltage sensing device electrically connected to the output of said voltage converter to generate a first signal and a current sensing device in series with said string to generate a second signal indicative of current flowing though said string; and a feedback device electrically coupled to said voltage converter, said voltage sensing device and said current sensing device, said feedback device receiving said first and second signals and providing the control signal to the voltage converter, said control signal based on the first and second signals; wherein said voltage converter changes the second magnitude voltage based on the control signal received from the feedback device.

In accordance with another aspect of the present invention there is provided a driving and control device for providing a desired switched current to a load including two or more strings of one or more electronic devices, said device comprising: a voltage converter adapted for connection to a power supply, said voltage converter for converting voltage from the power supply from a first magnitude voltage to a second magnitude voltage, said voltage converter responsive to a control signal; two or more dimming control devices receiving the second magnitude voltage and each dimming control device controlling transmission of the second magnitude voltage to a respective one of said two or more strings thereby controlling activation of the two or more said strings; a voltage sensing device electrically connected to the output of said voltage converter to generate a first signal and a current sensing device in series with said one of said two or more strings to generate a second signal indicative of current flowing though the one of said two or more strings; and a feedback device electrically coupled to said voltage converter, said voltage sensing device and said current sensing device, said feedback device receiving said first and second signals and providing the control signal to the voltage converter, said control signal based on the first and second signals; wherein said voltage converter changes the second magnitude based on the control signal received from the feedback device.

In accordance with another aspect of the present invention there is provided a driving and control device for providing a desired switched current to a load including a string of one or more electronic devices, said device comprising: a voltage converter adapted for connection to a power supply, said voltage converter for converting voltage from the power supply from a first magnitude voltage to a second magnitude voltage, said voltage converter responsive to a control signal; a dimming control device receiving said second magnitude voltage and controlling transmission of the second magnitude voltage to said string thereby controlling activation of said string; a current sensing device in series with said string to generate a sense signal representative of current flowing though said string; and a feedback device electrically coupled to said voltage converter and said sensing device, said feedback device receiving said sense signal and providing the control signal to the voltage converter, said control signal based on the sense signal; wherein said voltage converter changes the second magnitude voltage based on the control signal received from the feedback device.

In accordance with another aspect of the present invention there is provided a driving and control device for providing a desired switched current to a load including two or more strings of one or more electronic devices, said device comprising: a voltage converter adapted for connection to a power supply, said voltage converter for converting voltage from the power supply from a first magnitude voltage to a second magnitude voltage, said voltage converter responsive to a control signal; two or more dimming control devices receiving the second magnitude voltage and each dimming control device controlling transmission of the second magnitude voltage to a respective one of said two or more strings thereby controlling activation of the two or more said strings; a current sensing device in series with one or said two or more strings to generate a sense signal representative of current flowing though said one of said two or more strings; and a feedback device electrically coupled to said voltage converter and said current sensing device, said feedback device receiving said sense signal and providing the control signal to the voltage converter, said control signal based on the sense signal; wherein said voltage converter changes the second magnitude based on the control signals received from the feedback devices.

DETAILED DESCRIPTION OF THE INVENTION

Definitions

Figure 1A:
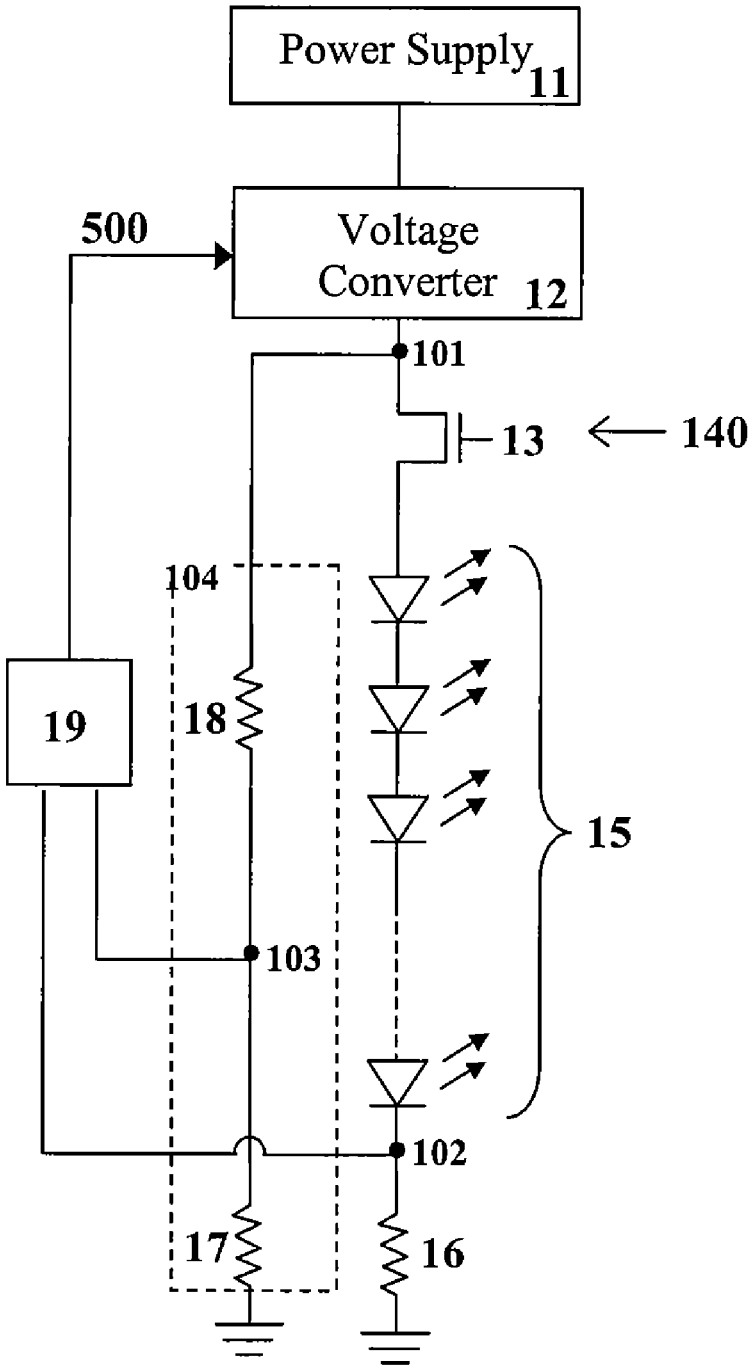
FIG. 1*a* illustrates a schematic representation of a lighting system according to one embodiment of the present invention.

The term "power supply" is used to define a means for providing power from a power source to electronic circuitry, the power being of a particular type, i.e. AC or DC, and magnitude.

The power source input to the power supply may be of any magnitude and type, and the output from the power supply may also be of any magnitude and type.

The term "voltage converter" is used to define a type of power supply that is used to convert an input voltage from one magnitude to an output voltage of another magnitude.

The term "electronic device" is used to define any device wherein its level of operation is dependent on the current being supplied thereto. Examples of an electronic device includes a light-emitting element, DC motor, laser diode and any other device requiring current regulation as would be readily understood by a worker skilled in the art.

The term "light-emitting element" is used to define any device that emits radiation in a particular region or combination of regions of the electromagnetic spectrum for example the visible region, infrared and/or ultraviolet region, when activated, by applying a potential difference across it or passing a current through it, for example. Examples of light-emitting elements include semiconductor light-emitting diodes (LEDs) or organic light-emitting diodes (OLEDs) and other similar devices as would be readily understood.

The term "string" is used to define a multiplicity of electronic devices connected in series or parallel or a series-parallel combination. For example, a string of light-emitting elements may refer to more than one of the same type of LED which can all be activated simultaneously by applying a voltage across the entire string thus causing them all to be driven with the same current as would be readily understood by a worker skilled in the art. A parallel string may refer to, for example, N LEDs in M rows with each row being connected in parallel such that all of the N×M LEDs can be activated simultaneously by applying a voltage across the entire string causing all N×M LEDs to be driven with ~1/M of the total current delivered to the entire string.

The term "load" is used to define one or more electronic devices or one or more strings of electronic devices to which to which power is being supplied.

The term "lighting" is used to define electromagnetic radiation of a particular frequency or range of frequencies in any region of the electromagnetic spectrum for example, the visible, infrared and ultraviolet regions, or any combination of regions of the electromagnetic spectrum.

Unless defined otherwise, all technical and scientific terms used herein have the same meaning as commonly understood by one of ordinary skill in the art to which this invention belongs.

The present invention provides a driving and control method for electronic devices in which a constant current flowing through them is desired as well as devices that may require a control signal for their operation. For example, this method can be used to provide a switched constant current source to light-emitting elements controlled using a Pulsed Width Modulation (PWM) signal, Pulsed Code Modulation (PCM) signal or any other digital control method known in the art. The present invention further provides a method for providing switched constant current sources to a plurality of electronic devices that have different forward voltages. For example, if multiple light-emitting element strings are to be powered by a single power supply, the present invention provides a method of providing individual voltages at the high side of each string and a switched constant current through each light-emitting element string.

The driving and control device according to the present invention provides a desired switched current to a load including a string of one or more electronic devices, and comprises one or more voltage conversion means, one or more dimming control means, one or more feedback means and one or more sensing means. The voltage conversion means may be a DC-to-DC converter for example and based on an input control signal converts the magnitude of the voltage from the power supply to another magnitude that is desired at the high side of the load. The dimming control means may comprise a switch such as a FET, BJT, relay, or any other type of switching device, for example, and provides control for activation and deactivation of the load. The feedback means is coupled to the voltage conversion means and a current sensing means and provides a feedback signal to the voltage conversion means that is indicative of the voltage drop across the current sensing means which thus represents the current flowing through the load. The current sensing means may comprise a fixed resistor, variable resistor, inductor, or some other element which has a predictable voltage-current relationship and thus will provide a measurement of the current flowing through the load based on a collected voltage signal. Based on the feedback signal received, the voltage conversion means can subsequently adjust its output voltage such that a constant switched current is provided to the load.

Figure 2:
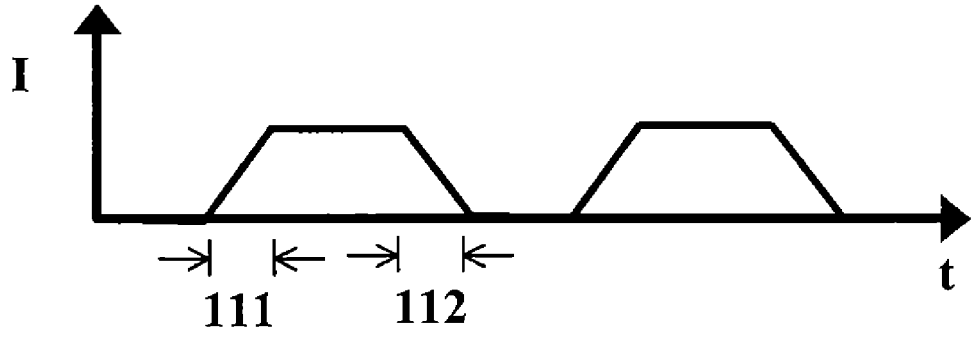
FIG. 2*a* illustrates a graphical representation of the relative current that may flow through the load in a prior art circuit in which the voltage converter is switched.
FIG. 2*b* illustrates a graphical representation of the relative current that may flow through the load in a lighting system according to one embodiment of the present invention wherein the load is switched.
Figure 2:
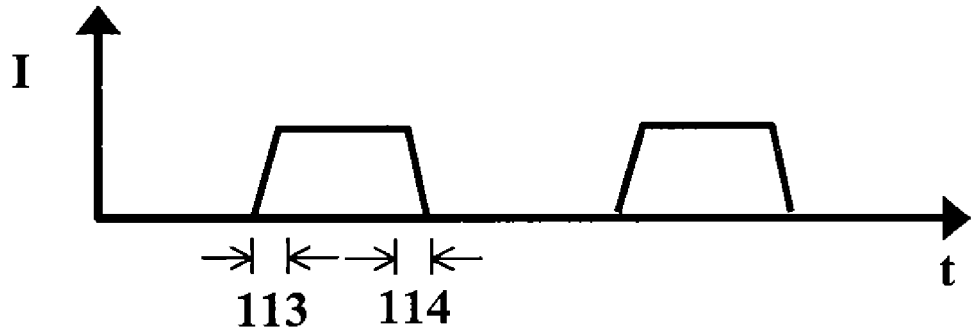

FIG. 1*a* illustrates a driver and control circuit according to one embodiment of the present invention. Power supply 11 is connected to voltage converter 12, which provides a suitable voltage at the high end of light-emitting element load 15. Voltage converter 12 is internally or externally switched at high frequency in order to change its input voltage to a different output voltage at node 101. In one embodiment the switching frequency may vary, for example between approximately 60 kHz to 250 kHz or other suitable frequency range as would be readily understood. In another embodiment the switching frequency may be fixed, for example at approximately 260 kHz, 300 kHz. Dimming of the light-emitting elements is provided by a dimming control signal 140, which may be a PWM, PCM or other signal, via transistor 13. Therefore, to control the switching ON and OFF of the light-emitting elements, the load of the circuit is digitally switched rather than switching the voltage converter at a low frequency to enable or disable it as is performed in the prior art. The present invention has an advantage of reducing switching transients and improving response times within the circuit since switching the load requires the switching of only a single transistor as opposed to multiple components that require switching in a voltage converter. For example, FIG. 2*a* illustrates a representation of the relative current that may flow through the load in a circuit in which the voltage converter is switched and FIG. 2*b* illustrates a representation of the relative current that may flow through the load according to one embodiment of the present invention in which the load is switched. The rise time 113 and fall time 114 of the signal illustrated in FIG. 2*b* can be significantly less than the rise time 111 and fall time 112 of the prior art signal.

In addition, a number of factors including the junction temperature and aging of light-emitting elements can affect the forward current thus causing variations in the forward voltage drop across the light-emitting element load 15. A signal 500 representative of this voltage drop is therefore fed back via signal conditioner 19 to voltage converter 12, which then adjusts its voltage output to maintain the current flowing through the light-emitting element load 15. Keeping the ON current through the light-emitting elements constant, can allow a substantially consistent and predictable brightness of the light-emitting elements to be obtained, and can also reduce the risk of compromising the lifetime of the light-emitting elements which can result from exceeding their maximum current rating. For example, state-of-the-art high-flux, one-watt LED packages have a maximum rating for average and instantaneous current of approximately 350 and 500 mA, respectively. Since the current can be controlled closely using the present invention, the light-emitting elements can be operated at their maximum average current rating without risk of exceeding their maximum instantaneous current rating.

Figure 3:
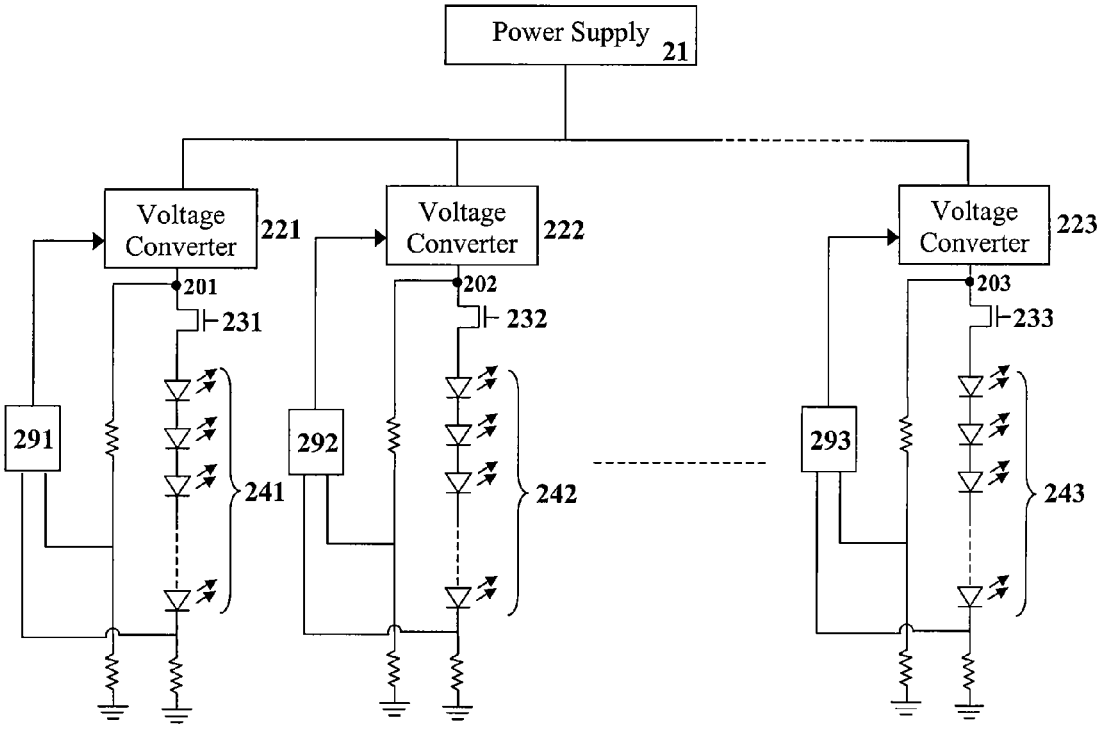
FIG. 3 illustrates a schematic representation of a lighting system according to one embodiment of the present invention wherein multiple light-emitting element strings are driven by a single power supply.

Furthermore, multiple light-emitting element strings can be driven using a single power supply 21 as illustrated in FIG. 3. Each light-emitting element loads 241, 242 and 243 may have its own voltage converter 221, 222 to 223 since each string may have a different total forward voltage. Each voltage converter 221, 222 to 223 is thus appropriately switched to provide the forward voltage required by the light-emitting element loads 241, 242 to 243, respectively to which it is connected. Feedback signals representative of the voltage drop across the light-emitting loads 241, 242 and 243 are sent back to voltage converter 221, 222 and 223 via signal conditioner 291, 292 and 293, respectively. An advantage of providing each light-emitting element string with an individual voltage converter is that every light-emitting element string may be operated approximately at its individual maximum current rating. In addition, having different voltage converters and a means for digitally switching the voltage for each string can allow each light-emitting element string to be dimmed over essentially a full range from 0% to 100%.

Voltage Conversion Means

The voltage conversion means of the present invention may be any means for converting a voltage of one magnitude from a power supply to a voltage of another magnitude, based on an input signal.

In the embodiment illustrated in FIG. 1*a*, power supply 11 may be used to convert AC power to DC power for example, and the voltage conversion means may be a DC-to-DC converter. The DC-to-DC converter may be a step-down switch mode power supply (SMPS), such as a Buck converter, for example. A Buck converter, or other converter, may be used with standard external components such as a diode, capacitor, inductor and feedback components. Buck converters are available in standard integrated circuit (IC) packages and together with the additional external components can perform DC-to-DC conversion with an efficiency of approximately 90% or higher. Examples of other converters that can be used in place of a Buck converter include Boost converters, Buck-Boost converters, Cuk converters and Fly-Back converters.

The voltage converter can operate at a high frequency to generate the particular voltage required by the light-emitting element string. By operating the voltage converter at high frequencies, high efficiency and low voltage ripple in the output voltage signal can be achieved. In addition, switching at high frequencies can allow the load to be switched at frequencies that are high enough to be outside the audible frequency range and can also aid in the reduction of thermal cycling of the electronic devices. This is an advantage over switching the voltage converter ON and OFF which is typically performed at low frequencies, for example typically less than 1 kHz.

In one embodiment in which multiple light-emitting element strings are to be driven by a single power supply, each light-emitting element string is connected to a voltage converter as illustrated in FIG. 3. Each voltage converter 221, 222 to 223, may be individually switched at a particular frequency, to produce the voltages desired at nodes 201, 202 to 203, respectively, in order to drive light-emitting element loads 241, 242 to 243, respectively. Thus, each light-emitting element string can be switched from a 0 to 100% duty cycle to give essentially the maximum and minimum intensity obtainable by the control signal input via transistors 231, 232 to 233. Therefore all the light-emitting elements can be dimmable down to very low duty cycles as well as being able to emit light at essentially maximum intensity. An advantage of the present invention is that each string can have a different forward voltage yet still have constant current and full dimming without large power losses.

In one embodiment in which multiple light-emitting element strings require the same voltage supply at the high end of the strings, these light-emitting element strings may have their high ends connected to a single voltage converter. The light-emitting elements may further be connected in a parallel and/or series configuration. FIG. 1*f* illustrates a plurality of light-emitting elements cross connected in a series-parallel arrangement according to one embodiment of the present invention. This configuration of light-emitting elements can provide better balance the current distribution among the light-emitting elements, for example.

Figure 4:
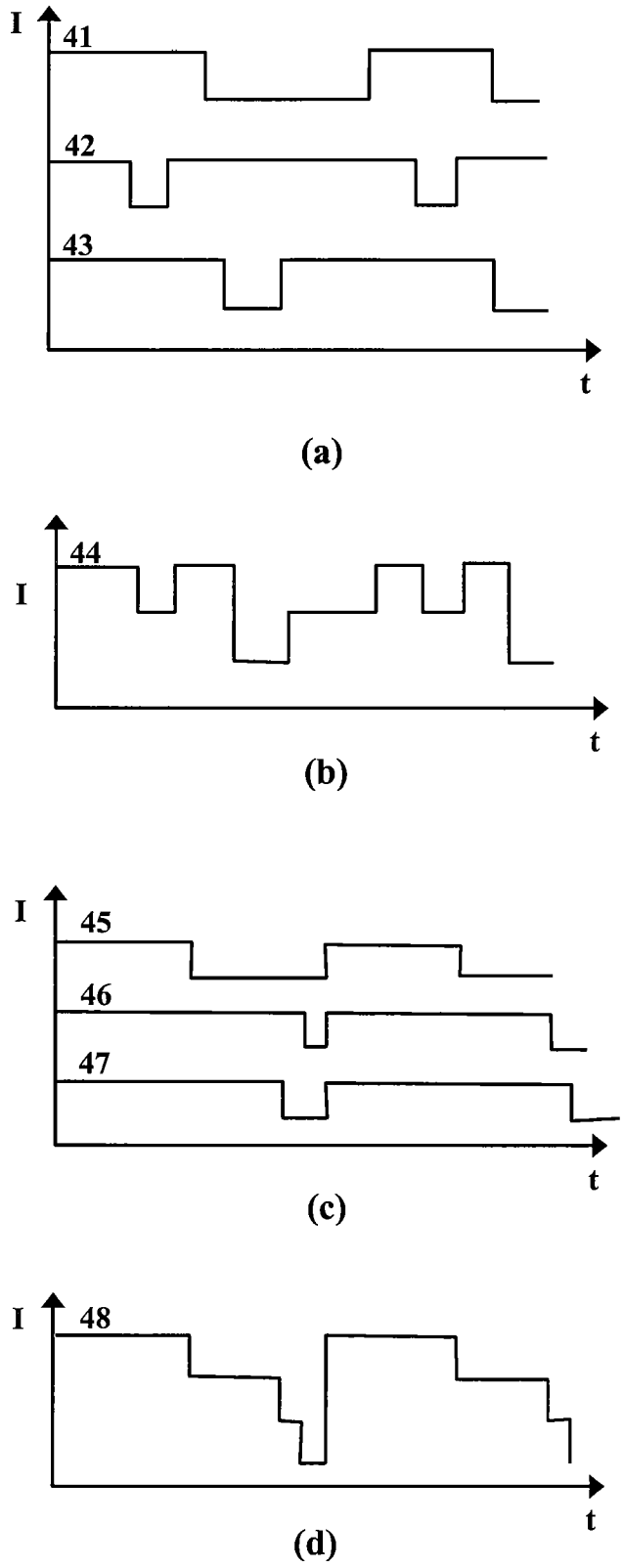
FIG. 4*a* illustrates a graphical representation of three signals input to three voltage converters connected to a power supply according to one embodiment of the present invention, wherein these signals are phase shifted relative to one another.
FIG. 4*b* illustrates a graphical representation of the total current drawn from the power supply during the input of the signals of FIG. 4*a*.
FIG. 4*c* illustrates a graphical representation of three signals input to three voltage converters connected to a power supply according to one embodiment of the present invention, wherein these signals are not phase shifted relative to each other.
FIG. 4*d* illustrates a graphical representation of the total current drawn from the power supply during the input of the signals of FIG. 4*c*.

Furthermore, in one embodiment of the present invention in which multiple light-emitting element strings are to be driven by a single power supply, the phase of one or more frequency signals input to the voltage converters may be phase shifted. FIG. 4*a* illustrates three signals 41, 42 and 43 that are input to three voltage converters connected to a power supply, wherein these signals are phase shifted relative to one another. FIG. 4*b* illustrates the total current 44 drawn from the power supply during the input of the signals illustrated in FIG. 4*a*. FIG. 4*c* and FIG. 4*d* illustrate three input signals 45, 46 and 47 that are not phase shifted with respect to each other and the total current 48 output by the power supply, respectively. Phase shifting of these input signals can allow the power supply load to be essentially balanced. In addition, when the voltage converter input signals are phase shifted, the power supply feeding the voltage converters may experience a higher frequency than when the input signals are not phase shifted. Therefore, the output from the power supply may further be filtered from various noise sources at lower frequencies.

Dimming Control Means

Dimming of light-emitting elements is typically done by switching the devices ON and OFF at a rate at which the human eye perceives the light output as an average light level based on the duty cycle rather than a series of light pulses. The relationship between duty cycle and light intensity may therefore be linear over the entire dimming range. As described earlier in relation to FIG. 1*a*, dimming can be provided using a dimming control signal 140 input via transistor 13. The load can typically be switched at a frequency that is lower than the switching frequency of the voltage converter 12 so that the ripple in the power supply output is averaged out over the time the load is switched ON. Switching the light-emitting elements at a relatively high frequency allows them to be switched at frequencies that are outside the audible range. In addition, switching the load at relatively high frequencies can reduce the effects of thermal cycling on the electronic devices since they are switched ON for a small fraction of time before being switched OFF again.

Figure 1B:
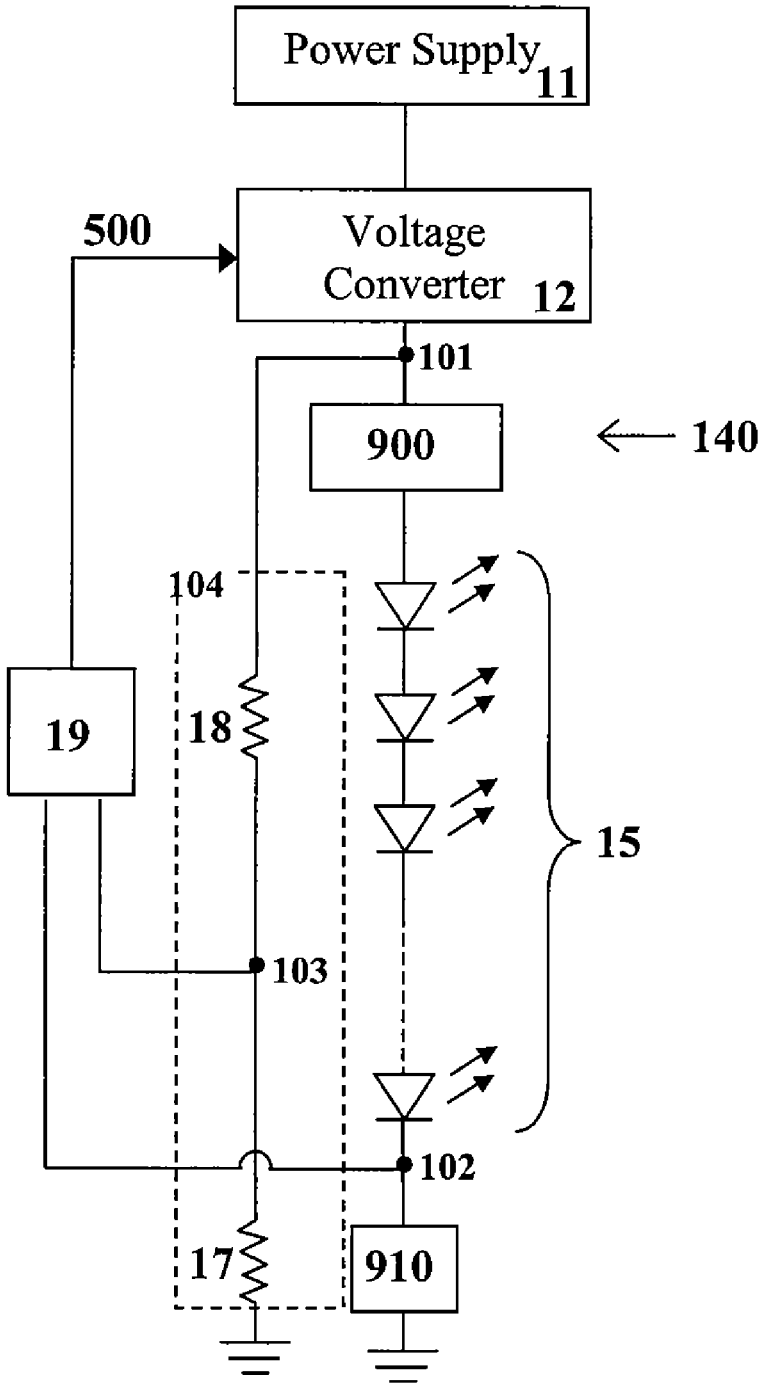
FIG. 1*b* illustrates a schematic representation of a lighting system according to another embodiment of the present invention.
Figure 1C:
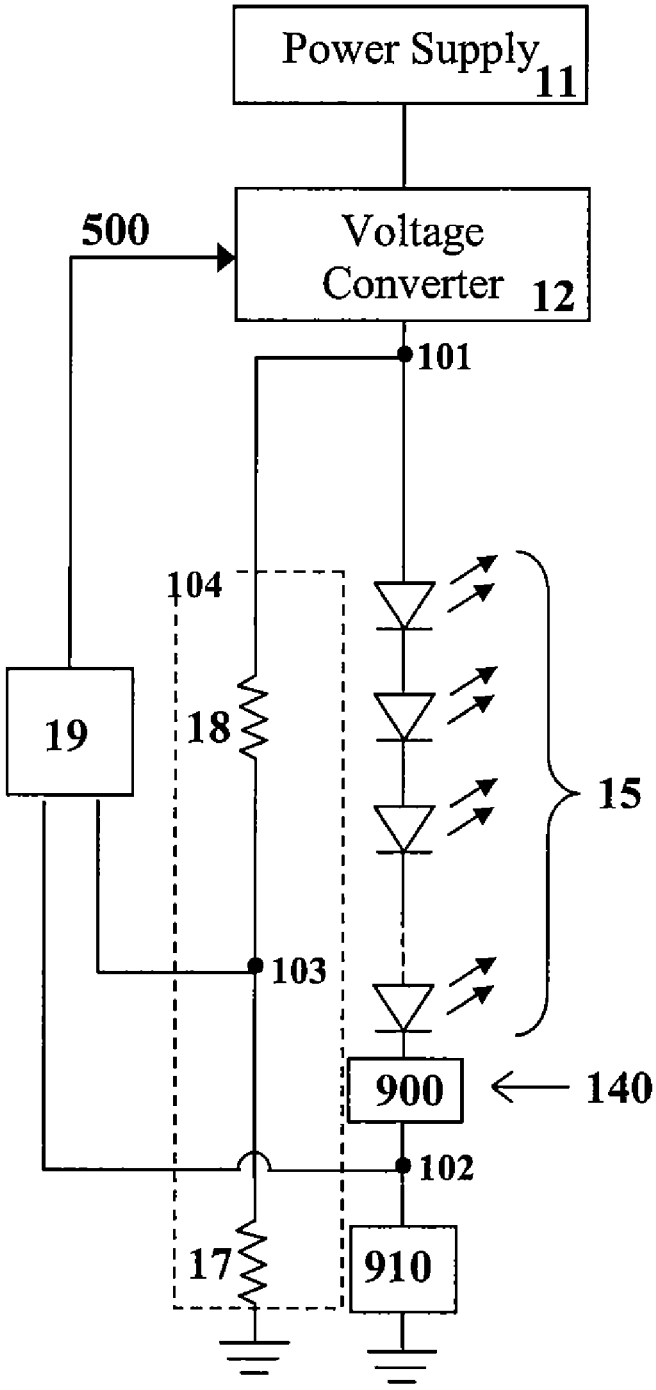
FIG. 1*c* illustrates a schematic representation of a lighting system according to another embodiment of the present invention.

Another embodiment of the present invention is shown in FIG. 1*b* and makes use of a switching device 900 located between the voltage converter 12 and the light-emitting element load 15, which can be a FET, BJT, relay, or any other type of switching device which makes use of an external control input 140 to turn ON or OFF the light-emitting element load 15. As shown in FIG. 1*c*, this device 900 may alternately be located on the 'low side' rather than the 'high side', that is, after the light-emitting elements rather than before them.

In one embodiment in which there are multiple light-emitting element strings driven by a single power supply, each light-emitting element string may have a common dimming control signal, that is, the gates of transistors 231, 232 to 233 may be connected together and to a single dimming signal. In addition, transistors 231, 232 to 233 may also have individual control signals for each light-emitting element string or groups of light-emitting element strings.

Sensing Means

Figure 1D:
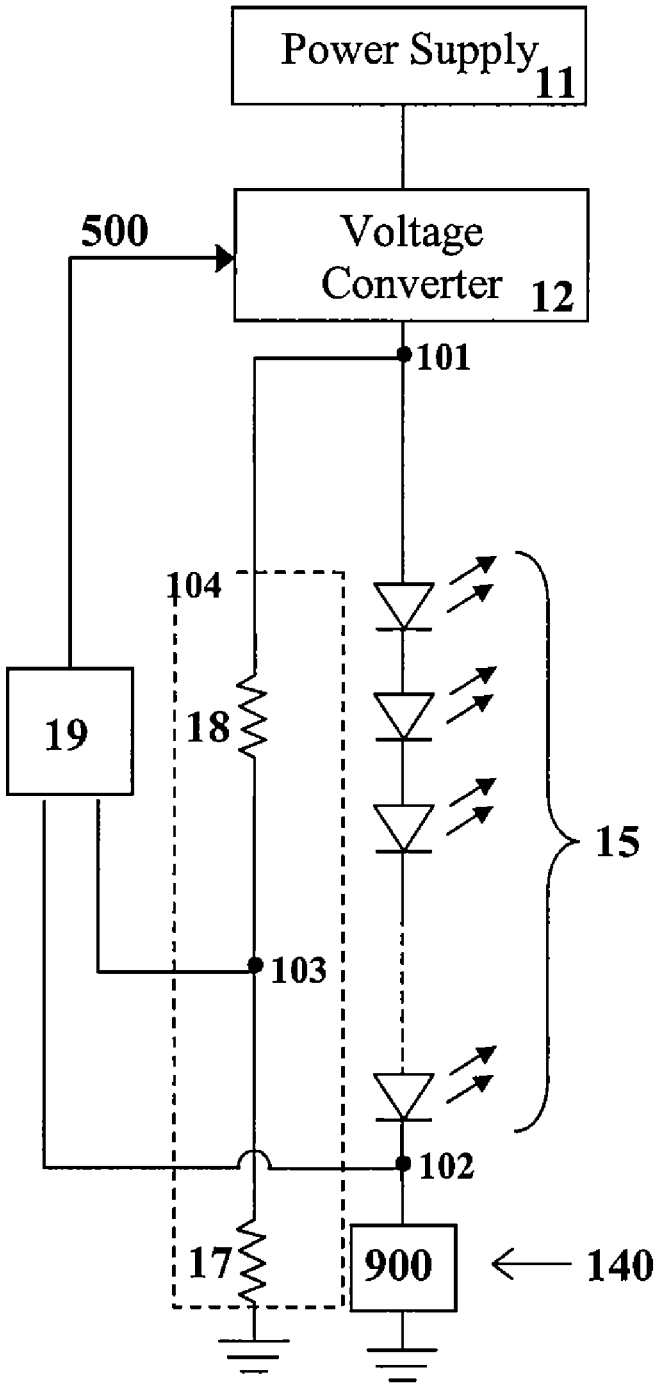
FIG. 1*d* illustrates a schematic representation of a lighting system according to another embodiment of the present invention.

One or more sensing means can be employed to maintain the current level through the load. In the embodiment of FIG. 1*a*, there is a voltage sensing means 104 and a current sensing means in the form of a resistor 16. When the light-emitting element load 15 is switched ON, the sense voltage at node 102 generated by resistor 16 is fed back to converter 12 via signal conditioner 19. Resistor 16 may be replaced by another element for generating the sense voltage at node 102, as indicated in FIGS. 1*b*, and 1*c*. Referring to the embodiments shown in FIGS. 1*b*, and 1*c*, the current sensing device 910 can be a fixed resistor, variable resistor, inductor, or some other element for generating the sense voltage signal 102 representative of the current flowing through the light-emitting element load 15 during the ON phase. As shown in FIG. 1*d*, current sensing device 910 may be eliminated and in its place switching device 900 can be used to both switch the light-emitting elements ON and OFF, as well as provide a means for generating the sense voltage signal 102. However, in this scenario since the resistance of the switching device 900 is kept small in order to avoid excessive power losses, this may result in the generation of a small sense voltage signal 102 which may reduce the effective resolution of the system, particularly at low peak currents. Furthermore the variability of the resistance of a typical FET, for example, from device to device, or at different ambient temperatures can introduce more variability in the sense voltage signal than desired. In one embodiment, current sensing device 910 is a low value, high precision sense resistor which is stable over a wide temperature range to ensure accurate feedback as shown in the embodiment of FIG. 1*a*.

Figure 1E:
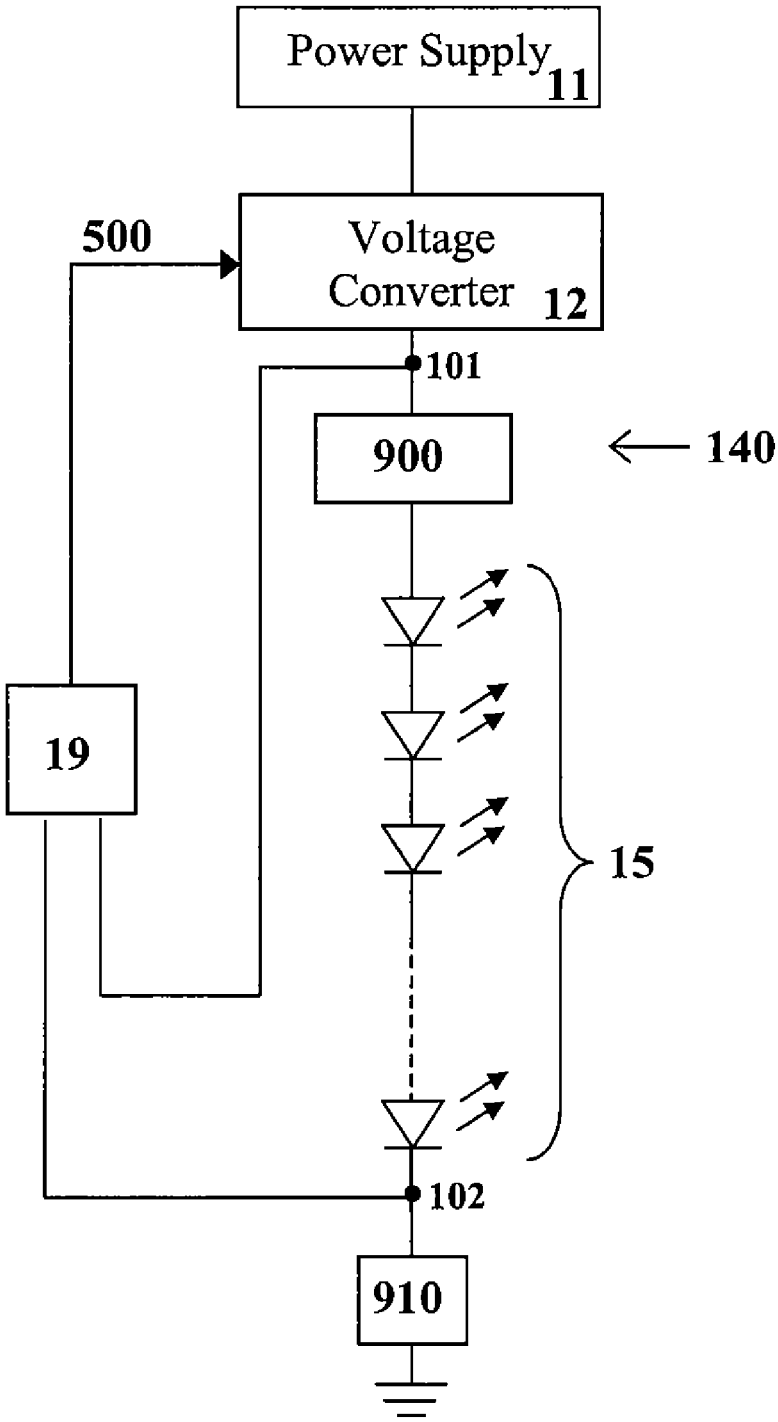
FIG. 1*e* illustrates a schematic representation of a lighting system according to another embodiment of the present invention.
Figure 1F:
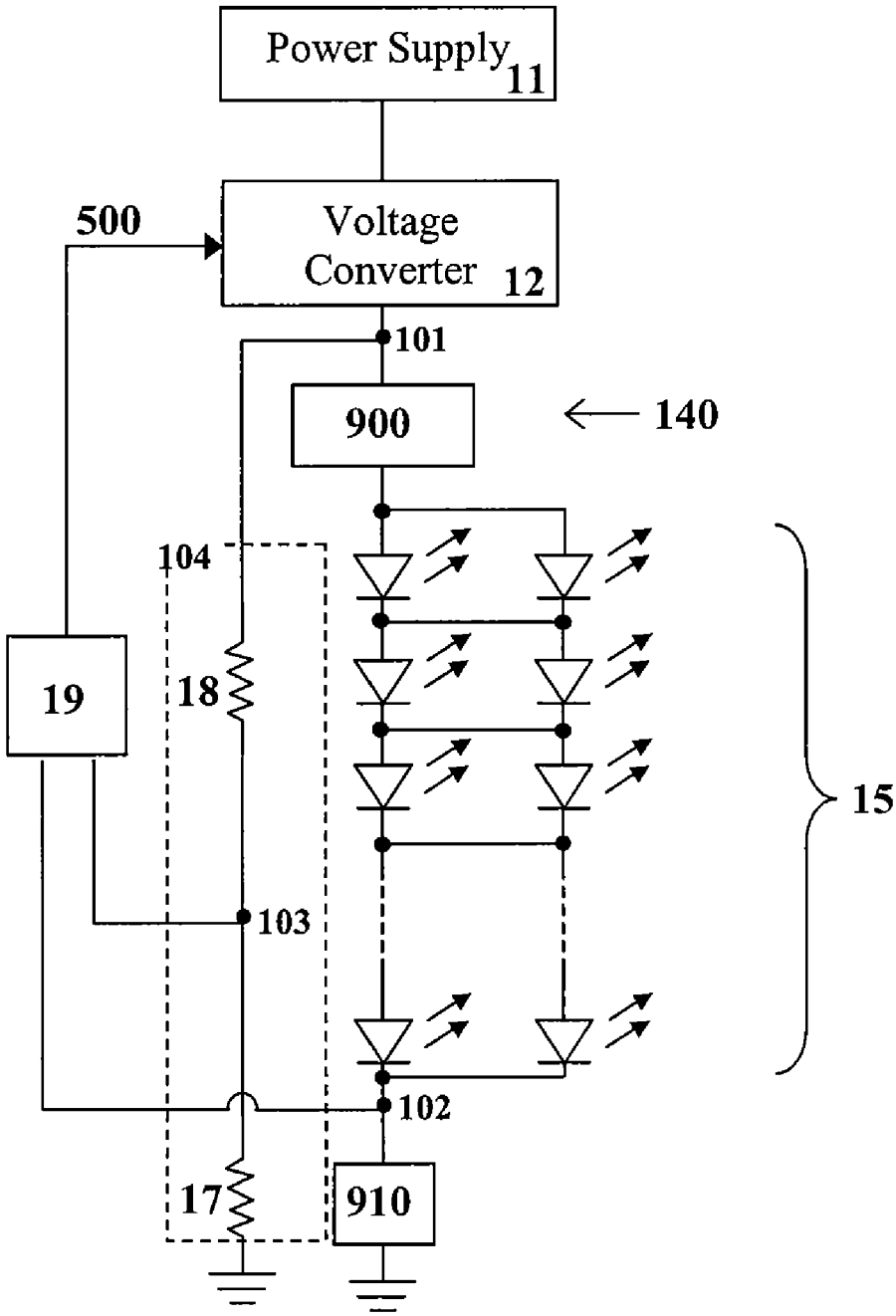
FIG. 1*f* illustrates a schematic representation of a lighting system according to another embodiment of the present invention.

As in FIG. 1*a*, in one embodiment the voltage sensing means 104 can comprise a resistor divider 17 and 18. In an alternate embodiment, the output of the voltage converter 101 may be connected to an input of signal conditioner 19 as shown in FIG. 1*e* where the voltage signal is processed using an op amp circuit with appropriate gain, or other method as would be readily understood by a worker skilled in the art.

Feedback Means

The feedback means is used to maintain the desired current level flowing through the electronic devices being driven during the ON phase. At turn on, the current flowing through the electronic devices causes a signal 520 at node 102 to be generated which is fed back to the voltage converter 12. Voltage converter 12 then adjusts its output voltage to provide a constant current to the light-emitting element load 15. When the light-emitting element load 15 is turned OFF, the voltage sensing means 104, is used to maintain the feedback signal required by voltage converter 12. Therefore when the load is switched back ON the output voltage will still be at the same set-point as when the load was switched OFF, thereby substantially eliminating any current spikes or dips in the load. As would be readily understood by a worker skilled in the art, signal conditioner 19 can comprise various types of circuitry.

An error may be introduced in the feedback signal as a result of using the voltage sensing means 104 in the feedback loop instead of a light-emitting element load 15. This error may increase as the light-emitting element ON-time decreases, however it may not be significantly important at relatively low duty cycles as the average light-emitting element current can be much lower than its rated current, and therefore the accuracy of the reading is not as critical in this instance.

Figure 5:
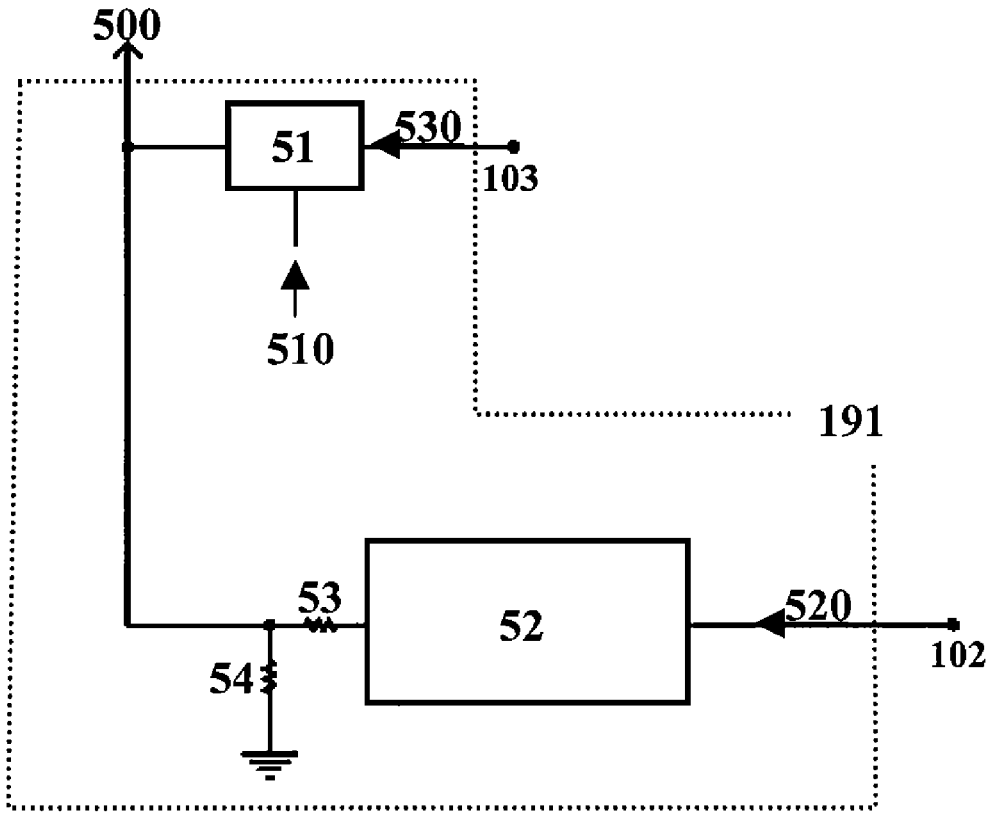
FIG. 5 illustrates a schematic representation of a signal conditioner according to one embodiment of the present invention.
Figure 6A:
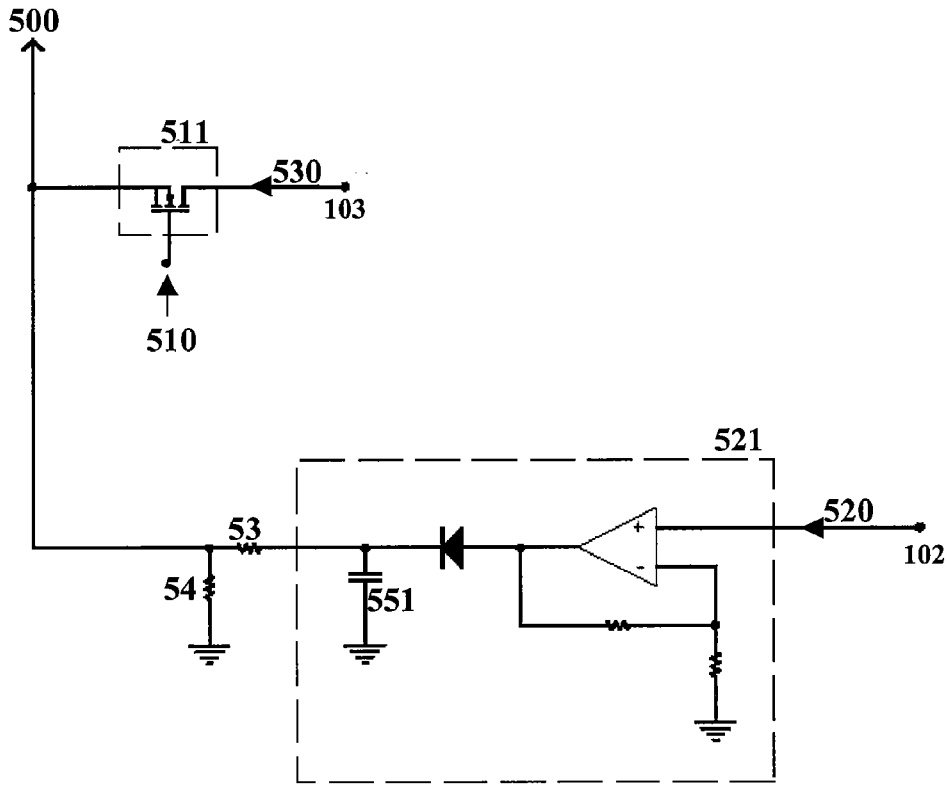
FIG. 6*a* illustrates a schematic representation of one implementation of the signal conditioner of FIG. 5.

In one embodiment of the present invention wherein signal conditioner 19 comprises the circuitry 191 illustrated in FIG. 5, the above identified error can be small at relatively low duty cycles and good control of the signal from voltage converter 12 can be obtained. Signals 530 and 520 are the signals from nodes 103 and 102 in FIG. 1*a*, respectively, and signal 500 is the signal fed back to voltage converter 12 from the signal conditioning circuitry. A switch 51 controlled by a digital input signal 510 connects signal 530 to voltage converter 12 only when the duty cycle of the dimming control signal 140 is below a predetermined threshold, for example 10%. Switch 51 may be a FET, BJT or any other switching means as would be readily understood. For higher duty cycles, a sample-and-hold circuit 52 can be used to capture signal 520 representative of the current through light-emitting elements 15 and to hold the signal 520 in order to maintain signal 500 to voltage converter 12 even while the light-emitting elements 15 are in the OFF state. Resistors 53 and 54 are used to compensate for any gain that may be applied by sample-and-hold circuit 52. FIG. 6*a* illustrates one implementation of the signal conditioning circuit 191. Switch 51 is implemented using a FET 511 and sample-and-hold circuit 52 is implemented by circuitry 521. As the duty cycle decreases, the signal on the hold capacitor 551 will have some error and below 10%, for example, the sample-and-hold circuit 521 may have difficulty capturing signal 520. Using external input 510, which may be another digital input from the controller supplying the dimming control signal, for example, switch 51 can be activated to allow signal 530 to override signal 520. If there is a relatively large difference between the predetermined voltage set point based on signal 520 and the predetermined voltage set point based on signal 530, then there will be a step in the output of the voltage converter which could cause an undesirably noticeable change in the light output from the light-emitting elements 15 which may result in visible flicker. Therefore, in one embodiment these two set points are kept at the same level.

Figure 6B:
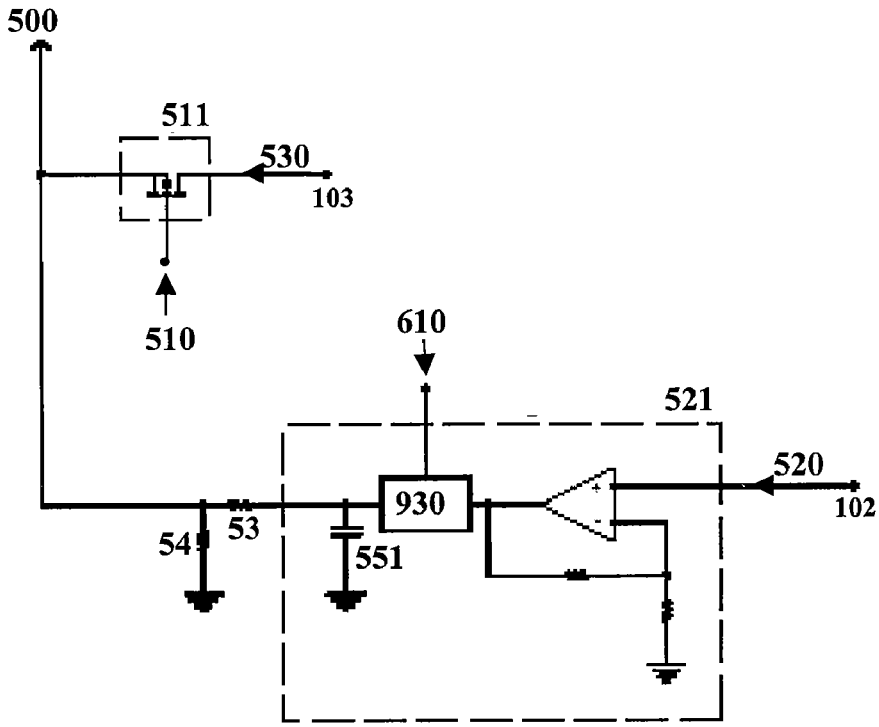
FIG. 6*b* illustrates a schematic representation of another implementation of the signal conditioner of FIG. 5.

In another embodiment shown in FIG. 6*b*, the diode shown in FIG. 6*a* is replaced by a device 930 such as a FET, relay, or other form of switching device with a control input 610. Thus the sample and hold function of 521 would be timed and controlled externally, instead of occurring automatically as in the embodiment of FIG. 6*a*.

Figure 7:
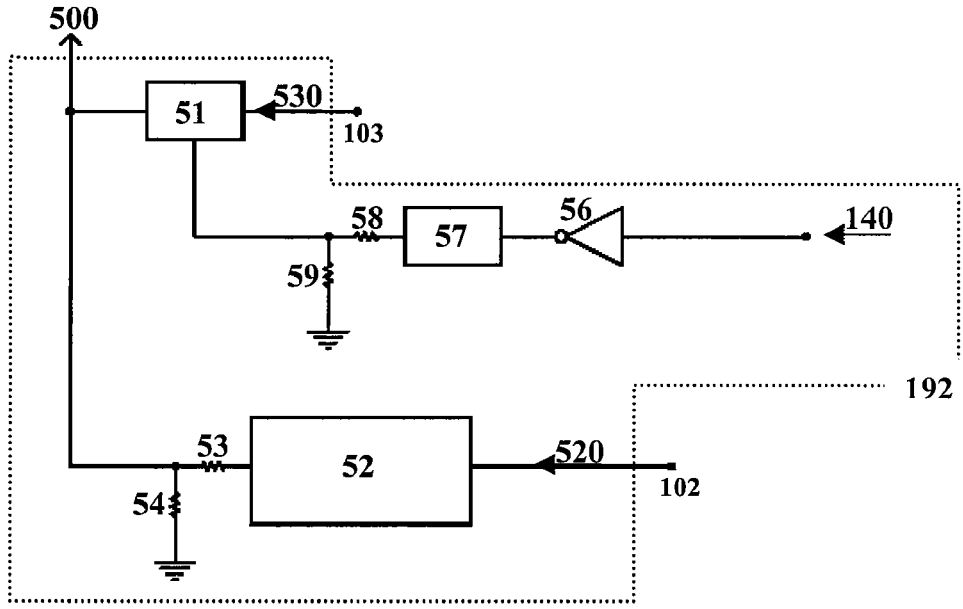
FIG. 7 illustrates a schematic representation of a signal conditioner according to another embodiment of the present invention.
Figure 8:
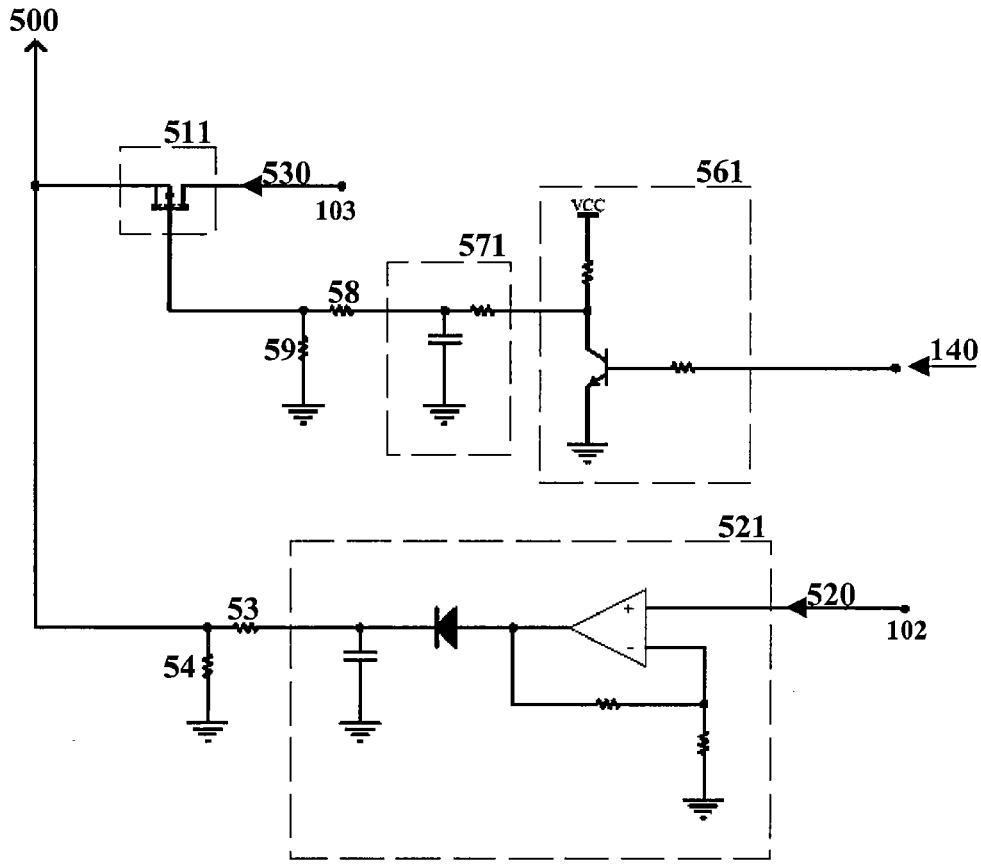
FIG. 8 illustrates a schematic representation of one implementation of the signal conditioner of FIG. 7.

In another embodiment of the present invention, the need for digital input signal 510 is eliminated by using the existing dimming control signal 140 to control switch 51 and thus to determine when voltage signal 530 dominates feedback signal 500. Such an embodiment is illustrated in FIG. 7 wherein signal conditioner 19 comprises circuitry 192. As in circuitry 191, circuitry 192 comprises switch 51, sample-and-hold circuit 52 and resistors 53 and 54, functioning in a similar manner. Dimming control input signal 140 is supplied to an inverter 56, and subsequently to a filter 57 and resistors 58 and 59. Inverter 56 inverts the control signal 140 so that signal 530 is only allowed to pass to voltage converter 12 when no current is flowing through light-emitting element load 15. Filter 57 is used to restrict the passage of high frequency components in the inverted control signal. Resistors 58 and 59 are used to compensate for any gain that may be applied by filter 57. This embodiment can further eliminate any discrete step changes in the output of voltage converter 12 by operating switch 51, such as a FET, or similar device, in its linear region. As would be known, switches of this type are not normally operated in this fashion since this operation can cause significant power loss. However in this case, as there is only a very small current flowing through the switch, the power losses are negligible. Thus, at high duty cycles of dimming control signal 140 the signal at switch 51 keeps it OFF, but as the duty cycle drops the signal controlling switch 51 rises allowing current to flow through it. FIG. 8 illustrates a schematic of one implementation of signal conditioning circuitry 192. Inverter 56 is implemented by circuitry 561 and filter 57 is implemented by low-pass filter circuitry 571. As would be readily understood, the functions of inverter 56 and the filtering circuitry may be performed using other components such as an inverter IC, or an op-amp based active filter. At a point determined by the characteristics of transistor 511 and voltage sensing means 104, the duty cycle of signal 140 can be high enough to allow current to flow through transistor 511, thereby allowing feedback signal 530 partially through it. At low enough duty cycles the switching signal will be high enough to turn transistor 511 fully ON thus allowing feedback signal 530 to completely override feedback signal 520. Since the resistance of transistor 511 will result in a gradual transition between feedback signal 530 dominating signal 500 and feedback signal 520 dominating signal 500 there is a smooth transition between the dominance of each signal thus eliminating any step changes in the output of voltage converter 12.

Figure 9:
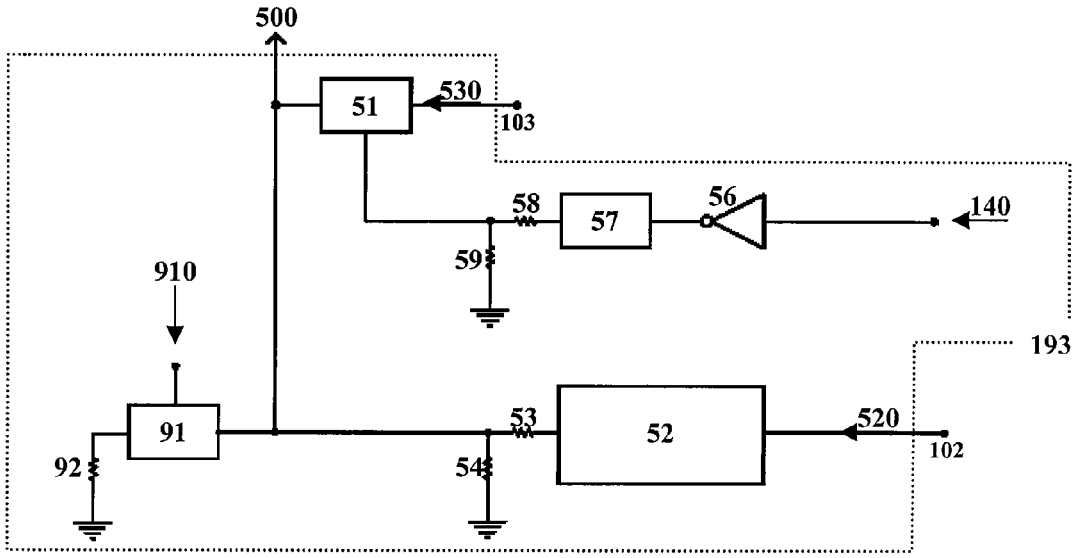
FIG. 9 illustrates a schematic representation of a signal conditioner according to another embodiment of the present invention.
Figure 10:
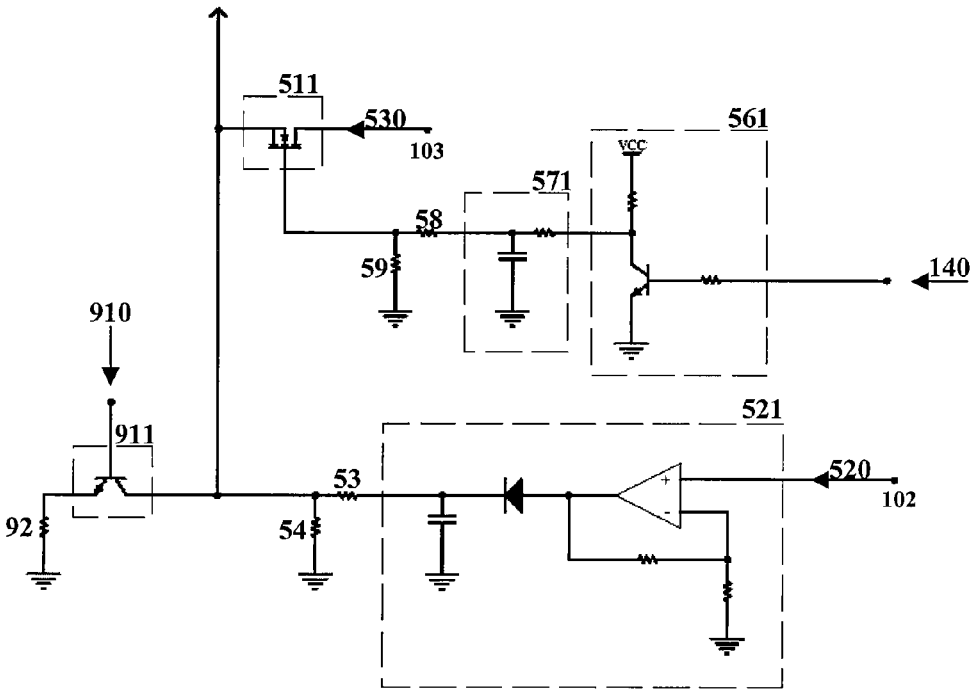
FIG. 10 illustrates a schematic representation of one implementation of the signal conditioner of FIG. 9.

In another embodiment of the present invention as illustrated in FIG. 9, signal conditioner 19 comprises circuitry 193 having a resistor 92 connected in parallel with resistor 17 of voltage sensing means 104 by means of a switch 91. Adding resistor 92 and switch 91 allows the current level through voltage sensing means 104 to be set to various levels depending on the value of resistor 92 by means of a digital input signal 910. When switch 91 is turned OFF the peak current level though voltage sensing means 104 is set to a value $I_0$ based on the resistances of the voltage divider. When switch 91 is then turned ON, the equivalent parallel resistance of the divider resistor 17 and resistor 92 decreases by a fixed amount which changes signal 530 such that the new peak current level flowing through voltage sensing means 104 will be a multiple of $I_0$. In this way activating switch 91 can produce a current boost in the feedback circuitry which can then be translated to the light-emitting element load 15. Used alternately, namely normally having switch 91 activated and then deactivating it causes the peak current through the voltage sensing means 104 to be reduced to some fraction of the initial level. This can allow the resolution of the system to be increased. For example, if the resolution of the dimming control signal 140 is nominally 8 bits then the average current through load 15 can be stepped from full current $I_0$ down to zero in 256 equal steps. By setting the value of resistor 17 and parallel resistor 92 such that deactivating switch 91 causes the peak current to drop to for example ¼ of its initial value, then the dimming control signal 140 duty cycle can be reduced from 100% down to 25% thus reducing the average current through light-emitting load 15 from $I_0$ down to ¼ $I_0$. Switch 91 can be subsequently deactivated and the dimming control signal 140 duty cycle reset to 100%, and at this new peak current level the dimming control signal controller can now reduce the average current from ¼ $I_0$ down to zero in 256 equal steps. Originally there would have been 64 steps in the lowest 25%, however as defined there are 256 steps resulting in an increase of a factor of 4. This increase in resolution translates to 2 bits of resolution, and therefore the overall system resolution has been increased from 8 bits to 10 bits. As would be readily understood by a worker skilled in the art, if the resistors and switch activation were set differently then a larger increase in resolution could possibly be achieved. This operation can be limited in practice by the accuracy of the sample-and-hold circuitry and current sense resistor 16. FIG. 10 illustrates one implementation of the signal conditioning circuitry inserted into the embodiment of FIG. 9 wherein switch 91 is implemented by a BJT 911.

In another embodiment of the present invention, signal 910 may be replaced with an analog signal, generated by a DAC (digital to analog converter) in the controller or by external circuitry, for example, to continuously change the peak current level, instead of changing it between two discrete levels as previously defined. For example, by linearly varying the analog signal which controls switch 911 at the same rate as the duty cycle dimming signal 140 is changed, the combined effect would be to produce square law dimming of the light-emitting elements. Other variations of the control signal are also possible as would be readily understood.

Figure 11:
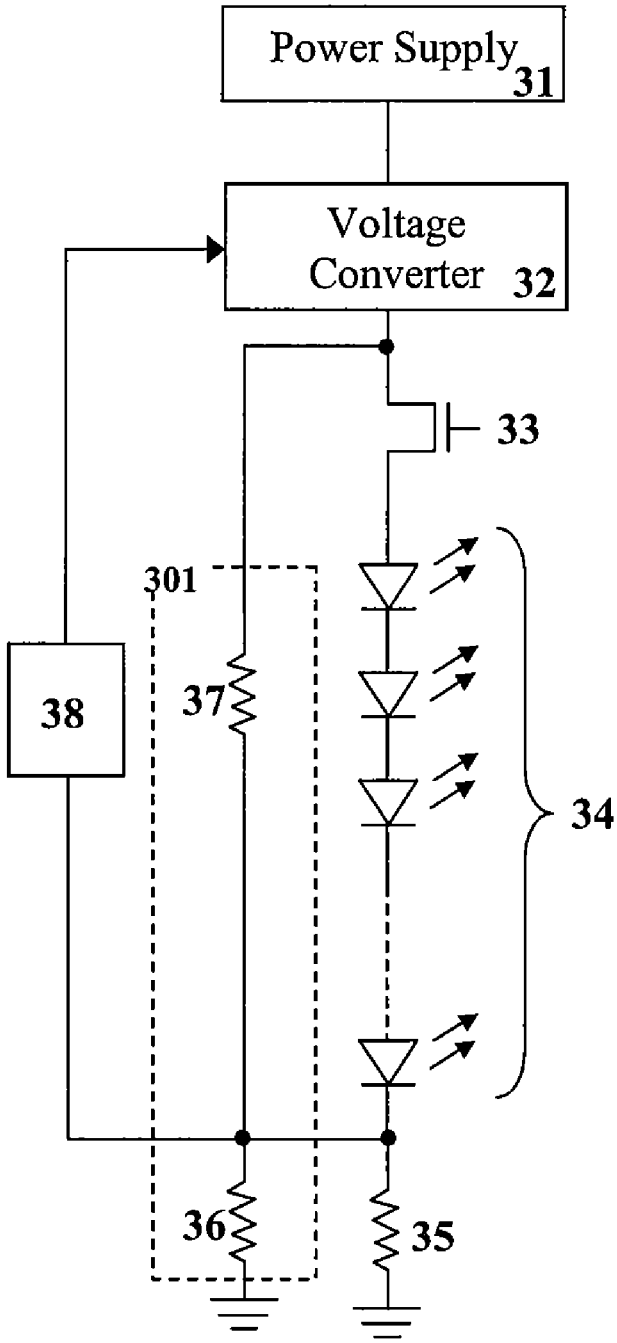
FIG. 11 illustrates a schematic representation of a lighting system according to one embodiment of the present invention wherein the feedback loop is connected in a wired-OR configuration.

In another embodiment as illustrated in FIG. 11, a resistor divider 301 feedback path is connected to the light-emitting element string 34 feedback loop in a wired-OR configuration. When the dimming switch 33 is in the ON state, the current passing through the light-emitting elements 34 and resistor 35 is larger than the current passing through the resistor divider 301 namely feedback resistors 36 and 37. Therefore, resistor 35 can dominate the feedback signal in the ON state. When switch 33 is in the OFF state, no current can flow through the light-emitting element string 34 or resistor 35, and the resistor divider circuit 301 dominates the feedback signal. In this way the feedback signal is maintained when the light-emitting element string 34 is turned OFF.

In another embodiment of the present invention, the resistor divider network includes a temperature sensitive device that changes the resistance of the resistor divider feedback loop as the light-emitting element junction temperature changes. For example, the temperature sensitive device may be a thermistor, or a standard transistor with a known temperature coefficient and can be used as the temperature sensitive element in a temperature compensation circuit as is common practice in the art. Therefore, when the light-emitting elements are in the OFF state, a dynamic alternate feedback path can be provided by the circuit. Although this embodiment may have an increased parts count, it may induce less error into the circuit compared to a circuit without such temperature-based correction.

In embodiments in which multiple light-emitting element strings are driven by a single power supply, components of the feedback loop of the circuit may be combined for all or groups of light-emitting element strings or may be separate components for each light-emitting element string being driven.

The embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A driving and control device for providing a desired switched current to a load including two or more strings of one or more electronic devices, said device comprising:

a) a voltage converter adapted for connection to a power supply, said voltage converter for converting voltage from the power supply from a first magnitude voltage to a second magnitude voltage, said voltage converter responsive to a control signal;

b) two or more dimming control devices receiving the second magnitude voltage and each dimming control device controlling transmission of the second magnitude voltage to a respective one of said two or more strings thereby controlling activation of the two or more said strings;

c) a voltage sensing device electrically connected to the output of said voltage converter to generate a first signal and a current sensing device in series with said one of said two or more strings to generate a second signal indicative of current flowing though the one of said two or more strings; and d) a feedback device electrically coupled to said voltage converter, said voltage sensing device and said current sensing device, said feedback device receiving said first and second signals and providing the control signal to the voltage converter, said control signal based on the first and second signals;

wherein said voltage converter changes the second magnitude based on the control signal received from the feedback device.

2. The driving and control device according to claim 1, wherein said voltage converter is a DC-DC converter.

3. The driving and control device according to claim 2, wherein the voltage converter is selected from the group including a buck converter, boost converter, buck-boost converter, cuk converter and a fly-back converter.

4. The driving and control device according to claim 1, wherein the voltage sensing device is selected from the group comprising a voltage divider and an op amp.

5. The driving and control device according to claim 1, wherein the current sensing device is selected from the group comprising a fixed resistor, variable resistor and inductor.

6. The driving and control device according to claim 1, wherein each of said two or more dimming control devices are selected from the group including a FET switch, BJT switch and a relay.

7. The driving and control device according to claim 1, wherein each of the two or more dimming control devices are controlled by a digital signal selected from the group including a pulse width modulation signal or a pulse code modulation signal.

8. The driving and control device according to claim 1, wherein each of said two or more strings has a high end and a low end, and one of said two or more dimming control devices is electrically coupled to the high end of one of the two or more strings.

9. The driving and control device according to claim 1, wherein each of said two or more strings has a high end and a low end, and one of said two or more dimming control devices is electrically coupled to the high end of one of the two or more strings.

10. The driving and control device according to claim 1, wherein the feedback device comprises a sample-and-hold circuit.

11. The driving and control device according to claim 1, wherein the feedback device is a circuit having a wired-OR configuration.

12. A driving and control device according to claim 1 wherein the desired switched current to the load can be changed to a different level.

13. A driving and control device for providing a desired switched current to a load including two or more strings of one or more electronic devices, said device comprising:

a) a voltage converter adapted for connection to a power supply, said voltage converter for converting voltage from the power supply from a first magnitude voltage to a second magnitude voltage, said voltage converter responsive to a control signal;

b) two or more dimming control devices receiving the second magnitude voltage and each dimming control device controlling transmission of the second magnitude voltage to a respective one of said two or more strings thereby controlling activation of the two or more said strings;

c) a current sensing device in series with one or said two or more strings to generate a sense signal representative of current flowing though said one of said two or more strings; and d) a feedback device electrically coupled to said voltage converter and said current sensing device, said feedback device receiving said sense signal and providing the control signal to the voltage converter, said control signal based on the sense signal;

wherein said voltage converter changes the second magnitude based on the control signals received from the feedback devices.

14. The driving and control device according to claim 13, wherein said voltage converter is a DC-DC converter.

15. The driving and control device according to claim 14, wherein the voltage converter is selected from the group including a buck converter, boost converter, buck-boost converter, cuk converter and a fly-back converter.

16. The driving and control device according to claim 13, wherein the current sensing device is selected from the group comprising a fixed resistor, variable resistor and inductor.

17. The driving and control device according to claim 13, wherein each of said two or more dimming control devices are selected from the group including a FET switch, BJT switch and a relay.

18. The driving and control device according to claim 13, wherein each of the two or more dimming control devices are controlled by a digital signal selected from the group including a pulse width modulation signal or a pulse code modulation signal.

19. The driving and control device according to claim 13, wherein each of said two or more strings has a high end and a low end, and one of said two or more dimming control devices is electrically coupled to the high end of one of the two or more strings.

20. The driving and control device according to claim 13, wherein each of said two or more strings has a high end and a low end, and one of said two or more dimming control devices is electrically coupled to the high end of one of the two or more strings.

21. The driving and control device according to claim 13, wherein the feedback device comprises a sample-and-hold circuit.

22. The driving and control device according to claim 13, wherein the feedback device is a circuit having a wired-OR configuration.

23. A driving and control device according to claim 13 wherein the desired switched current to the load can be changed to a different level.

* * * * *